United States Patent [19]

Kardash, Jr.

[11] 4,152,871

[45] May 8, 1979

[54] VEHICLE BARRICADE

[75] Inventor: William E. Kardash, Jr., Bryans Road, Md.

[73] Assignee: The United States of America as represented by the Attorney General, Washington, D.C.

[21] Appl. No.: 886,869

[22] Filed: Mar. 15, 1978

[51] Int. Cl.[2] ..... E01F 13/00

[52] U.S. Cl. ..... 49/49; 49/387

[58] Field of Search ..... 49/49, 35, 40, 387, 49/200

[56] References Cited

U.S. PATENT DOCUMENTS

| | | | |
|---|---|---|---|
| 1,949,295 | 2/1934 | Dean | 49/49 X |
| 2,558,220 | 6/1951 | McLachlan | 49/200 |

*Primary Examiner*—Kenneth Downey

*Attorney, Agent, or Firm*—Joseph A. Hill; Thomas J. Byrnes; Thomas J. Scott, Jr.

[57] ABSTRACT

A vehicle barricade including a barrier plate which can be raised or lowered and a counterweighted sector mounted near the side of the barrier plate. The counterweight is mounted on the sector so that the barrier plate will remain in the raised or lowered position without independent mechanical aid. The barricade is so constructed and secured that it is able to withstand impact from either heavy or light vehicles. The barricade may also be reenforced by placing auxiliary pillars adjacent to the barrier plate and which pillars cooperate with the barrier plate to further secure it when raised.

7 Claims, 6 Drawing Figures

VEHICLE BARRICADE

GOVERNMENT LICENSE

This invention described herein may be manufactured and used by or for the government of the United States of America for governmental purposes without the payment of any royalties thereon or therefore.

This invention pertains to a vehicle barricade and more particularly pertains to a vehicle barricade which is able to withstand the impact from approaching vehicles. The invention is particularly useful in securing the approaches to sensitive areas which might otherwise be vulnerable to attack.

BACKGROUND OF THE INVENTION

Many types of flush mounted, slant surface gates and barricades have been designed to control traffic flow either into or out of a controlled area such as at rail and highway intersections, bridges, or parking lots. These prior art designs incorporate complex electrical or mechanical control systems for the controlled or automatic raising and lowering of a gate or barrier plate, for example, as shown in U.S. Pat. Nos. 2,327,366; 2,741,859 and 3,748,782. Typical prior art electrical control systems are activated by tickets, dispensors, coin machines, or credit card type machines. They are designed to provide limited control of vehicular movement in one or both directions. Other typical prior art mechanical control systems cause the barrier plate to move up or down in response to a vehicle moving over the barrier plate in the desired direction and prevented movement of vehicles in the opposite or undesired direction.

Prior art flush mounted barrier plate designs often require excavation below the surface of the ground for placement of control components, such as springs, bearings, linkage or hydraulic or electro-mechanical elements to move the barrier plate. Prior art systems are not easily adapted to vehicular entrances to buildings where the locations of basements, snow-melting cables, and water-proofing or other structural considerations preclude excavation. Also, prior art barricades and barrier plates presented a slant surface at the approximate wheel elevation of a vehicle. Such an arrangement would not damage an approaching vehicle when the vehicle contacts the slant surface. Other prior art barricades have been of slight construction or not flush mounted as in U.S. Pat. No. 1,460,200. Such barricades provide limited protection against persons who might seek forced access to a sensitive area.

It is therefore an object of this invention to provide a surface mounted, protective gate or barricade designed to deny access of vehicles to an area. Another object of this invention is to provide a barrier plate which, when raised, prevents forced access by vehicles from one direction. A further object of the invention is to permit free passage of vehicles from either direction when the barrier plate is in a lowered position. An additional object of the invention is to provide a barricade capable of withstanding heavy impact. It is a further advantage of the present invention to provide a simplified surface mounted apparatus, comprising minimal moving parts, which can be manufactured, installed and maintained with comparative ease.

A further object of the present invention is to provide a design with inherent flexibility permitting a change in the barrier plate angle and height of the barrier plate edge from the roadway so that there would be only limited damage to a vehicle contacting the barrier plate.

A further object of this invention is to provide simplified installation of a powered barricade.

It is a further object of this invention to provide pillars adjacent to the barrier plate which cooperate with the barrier plate when raised to add greater structural integrity to the barricade.

Other objects of this invention will appear from the following description and appended claims.

SUMMARY OF THE INVENTION

This invention contemplates a vehicle barricade comprising pivotally mounted barrier plate with at least one sector mounted near the side of the barrier plate. The sector is counterweighted so that the barrier plate remains either raised or lowered without independent mechanical aid. Actuating power is provided for rotating the barrier plate about its pivot so that it may be raised or lowered.

DESCRIPTION OF THE PREFERRED EMBODIMENTS

Figure 1:
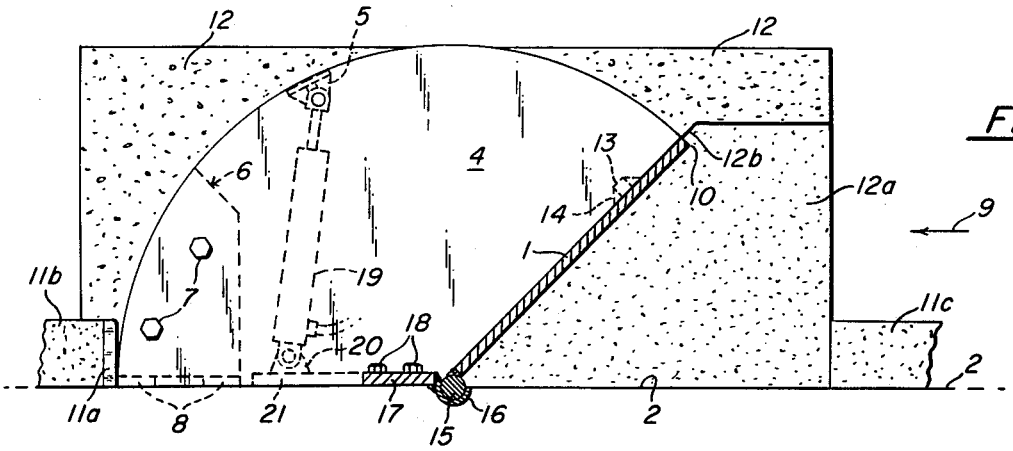
FIG. 1 is a vertical sectional view of the vehicle barricade when the barrier plate is in the raised position, taken along line 1—1 in FIG. 5 and looking in the direction of the arrows.

The vehicle barricade of this invention has a pivotally mounted barrier plate and one or more sectors mounted near the side of said barrier plate. These sectors are counterweighted so that the barrier plate will remain in either raised or lowered position without independent mechanical aid. The barrier plate is moved or rotated by various driving or actuating means well-known in the art such as hydraulic cylinders, rotary actuators or the like. The sectors act as supports and braces for the barrier plate to withstand impact when the barrier plate is in the raised position. The vehicle barricade can be used in conjunction with a stop or curb so located that said stop or curb is immediately behind the sector when the barrier plate is raised. Pillars may also be provided to give additional support to the barrier plate when the barrier plate is struck by a vehicle.

This invention permits installation over constructed areas, driveways equipped with snow-melting equipment, electrical conduits, or similar apparatus where structural considerations might otherwise preclude a barricade. The novel counterweighted sectors allow the barrier plate to be rotated by surface mounted hydraulic or mechanical devices and obviate the need for excavation below the barrier plate.

By selection of a particular barrier plate thickness and appropriate sizing of other elements of the invention, the barricade can be made to withstand the impact of vehicles ranging from standard motor cars to armored vehicles with no major changes in the drive or actuating system. This additional strength is the result of a group of novel elements which act together to provide increased structural integrity. These elements include, among others, the sectors carrying counterweights which allow the barrier plate to be maintained in either a raised or lowered position without independent mechanical aid. The counterweights also reduce the power needed to effect barrier movement. The sectors can also limit barricade and barrier plate movement when undergoing impact because a stop or curb can advantageously be placed behind any sector. This stop or curb limits the horizontal barrier movement away from the point of impact. The barricade also can include buttressing support members or pillars on either side of the barrier plate which add to the barricade's structural integrity.

For example, a barricade of this type may be used for a number of specific applications. If the barrier plate angle is maintained low and the distance between the barrier plate's forward edge and street is short, then contact would be made only with the wheels of an on-coming vehicle. In such circumstances, barricades could be made of relatively light material and the barricade could be used as a block for parking lots or like entrance ways. If the barricade is increased in size and the height of the barrier plate's forward edge is at the bumper or grill level of a vehicle, the barrier can be used to restrict entrance to any area which is in need of greater security. Suitable barricades of this type can be used at the entrance to a runway apron to prevent entry of dangerous vehicles or forced attack on aircraft. Similar barricades may be used to secure entrance ways to public buildings and public or private sites, mansions or estates. If suitable padding is added to the plate's forward barrier edge, the barricade can be used to prevent vehicles from endangering themselves such as a control gate at a ferry slip or the like.

Now having generally described the vehicle barricade of this invention, reference is made to the drawings to describe specific embodiments of the invention which are illustrative of the device, when used to secure an area requiring maximum security.

Figure 2:
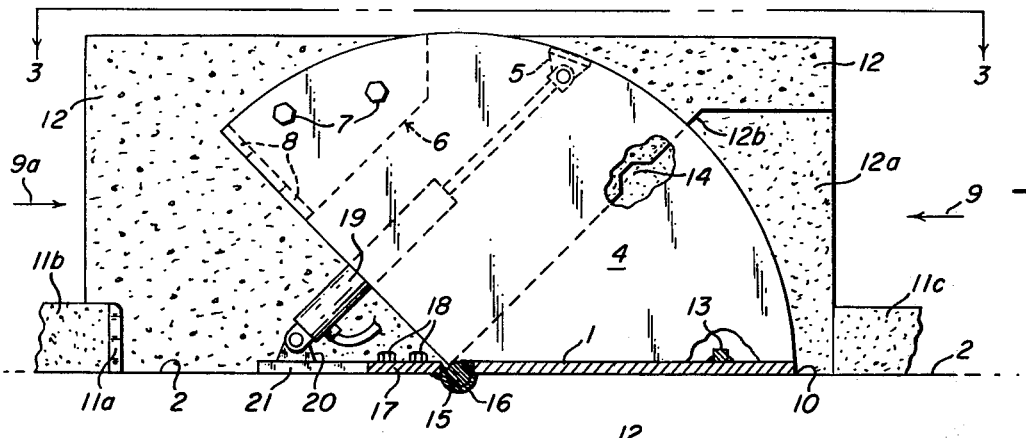
FIG. 2 is a vertical sectional view of the vehicle barricade when the barrier is in the lowered position, also, taken along line 1—1.
Figure 3:
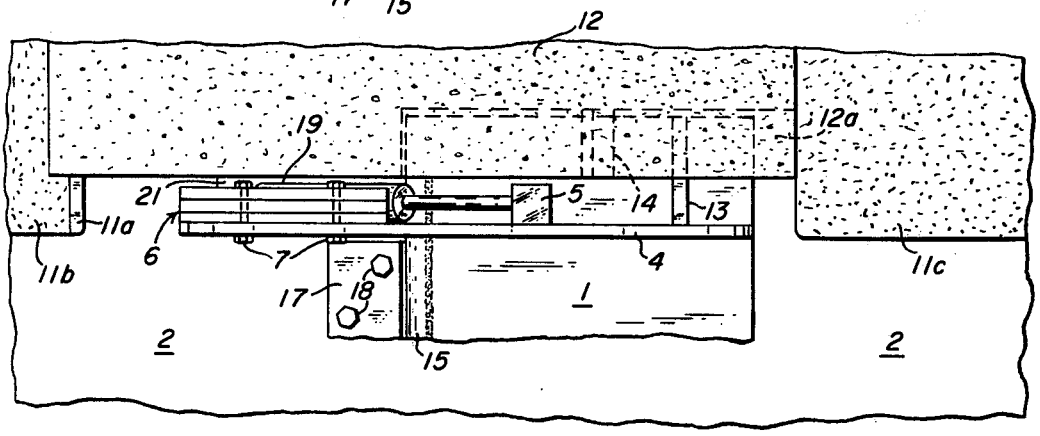
FIG. 3 is a top plan view of a side of the barricade including a hydraulic or mechanical actuating member taken along line 3—3 in FIG. 2 and looking in the direction of the arrows.
Figure 4:
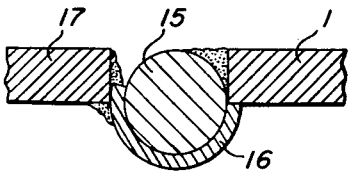
FIG. 4 is a detailed view of the barrier plate pivot shaft and seat in which the pivot is mounted.
Figure 5:
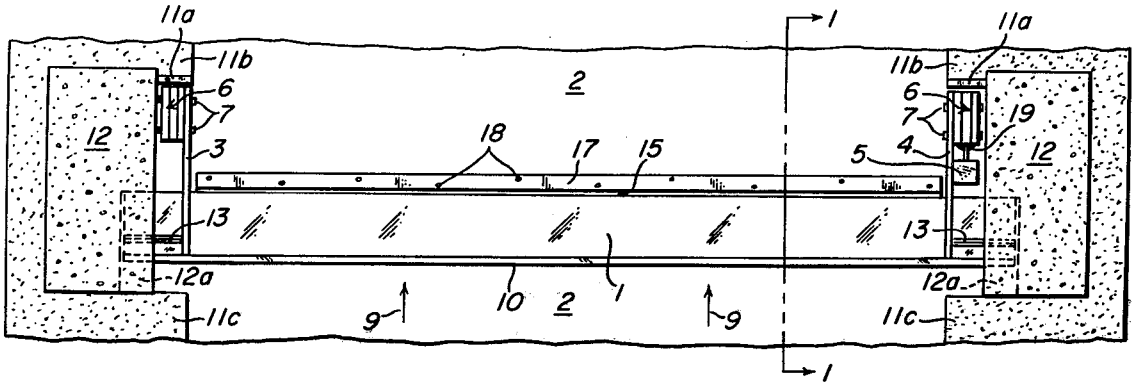
FIG. 5 is a top view of the vehicle barricade.
Figure 6:
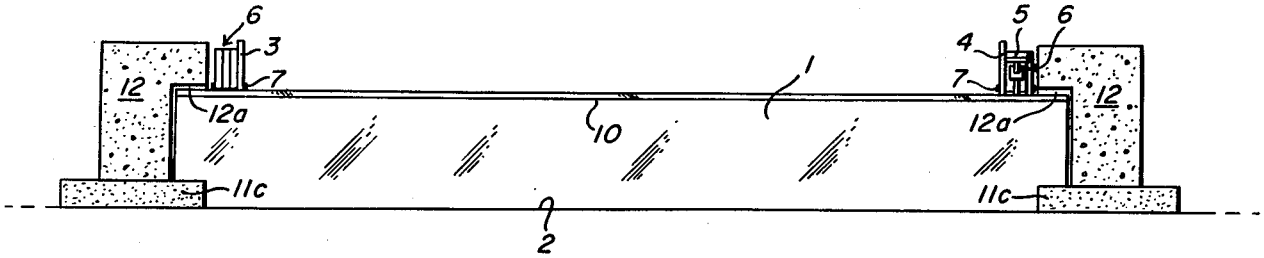
FIG. 6 is a front view of the vehicle barricade in the raised position as in FIG. 2.

The vehicle barricade includes a barrier plate, 1, the strength, shape, size and mass of which is chosen based on the type of vehicle against which protection is desired. The barrier plate, 1, is moveable to and from a lowered position horizontal to the roadway, 2, as shown in FIG. 2 and a raised or slant position as shown in FIG. 1 and FIG. 6. In the lowered position, barrier is flush with the roadway, 2, and access is allowed from either the direction, 9 or 9*a*. If the barrier is raised as shown in FIG. 1, access is prevented from the direction, 9.

Perpendicular to the barrier plate, 1, and attached near its sides are two sectors, 3 and 4, although the barrier will function adequately with one. Although these sectors may have any angle depending on the application, it is preferred that the sector have an angle of 135° to maximize stress distribution and obtain a barrier angle with respect to the roadway of 45°. Either one or both of the sectors may be used as an anchor point, 5, for a conventional hydraulic or electro-mechanical device, 19, which rotates the barrier plate, 1, and attached sectors, 3 and 4, about a common lower edge axis. This common lower edge axis consists of a cylindrical steel shaft, 15, mounted in a shaft seat, 16. This lower edge pivot axis apparatus will be described in greater detail below.

Each sector has a contoured counterweight, 6. The counterweight consists preferably of a plate or group of plates contoured to the sectors, 3 and 4. The counterweight is mounted by throughbolts, 7, and supported on the sectors, 3 and 4, by welded angle brackets, 8, at the sector heel, 8. The mass of the counterweight, 6, is selected to balance the barrier plate 1 and attached sectors, 3 and 4, at a midpoint between the raised and lowered positions. When the hydraulic or electro-mechanical means is attached to only one sector, the mass of the counterweight, 6, on each sector can be individually varied to reduce any torsional twist of the barrier plate, 1, which might result from actuation of the hydraulic or electro-mechanical means, 19, to move the barrier from one position, raised or lowered, to another.

The counterweight, 6, will maintain the barrier plate, 1, in either the raised or lowered position without independent mechanical aid. Additionally, the counterweight, 6, increases the mass of the barricade apparatus, i.e., the barrier plate, 1, and sectors, 3 and 4, thus increasing the resistance of the barricade to movement upon impact. The sectors, 3 and 4, also limit the rotation of the barrier plate, 1, in the raised position to the desired angle, in the preferred embodiment, 45°.

When the sector heel, 8, contacts the roadway, 2, the barrier plate, 1, comes to rest and will maintain itself in the raised position as shown in FIG. 1 and FIG. 6. In the raised position, the barrier plate 1 is preferably elevated at 45° to the roadway, 2, and presents a knife-edge, 10, to approaching vehicles. Preferably, a stop or curb, 11*b*, can be placed and anchored so as to be behind the sectors, 3 and 4, when the barrier plate is raised. This curb or stop will further preclude the possibility of movement of the barrier plate, 1, upon impact by a vehicle approaching from the direction, 9. Additionally, if the curb, 11*b*, is made of concrete or similar material, a curb kick plate, 11*a*, made of any non-abrasive material, may be installed to protect the curb, 11*b*, from wear by contact with the sectors, 3 and 4.

Further, concrete pillars and similar structures, 12, may be placed adjacent to the barrier plate, 1. When the barrier plate, 1, is in the raised position, the sides of barrier plate, 1, outside of the sectors, 3 and 4, will contact a face, 12*b*, in a recess, 12*a*, in the pillar, 12. Thus, the barrier plate will be additionally secured against movement when impacted. In such installations where concrete pillars, 12, are used, a steel shaft, 13, may be welded to the back surface of the outboard portion of the plate, 1, between the sectors, 3 and 4, and the end of the barrier plate, 1. This shaft, 13, fits into a corresponding keyway, 14, in the face, 12*b*, of the recess, 12*a*, of the concrete pillar, 12. The union of the shaft, 13, in the keyway, 14, also limits barrier displacement upon impact.

Welded to the barrier plate, 1, at its pivot axis, is a cylindrical steel shaft, 15. This shaft, 15, pivots in a halfround pipe, 16, welded to a steel plate, 17. The halfround pipe, 16, is recessed in the drive surface. The steel plate, 17, is anchored to the roadway, 2, by steel bolts, 18. This anchored steel plate, 17, limits barrier edge distortion and displacement upon impact. Rotation of the barrier plate, 1, is preferably accomplished by a double acting drive cylinder, 19. This cylinder, 19, is secured to a mount, 20, located on a baseplate, 21. This baseplate, 21, is located adjacent to the outside edge of the heel of the sector, 4. This baseplate, 21, is anchored to the roadway, 2. The drive cylinder, 19, can be an electro-mechanical or hydraulic device of any conventional design and does not itself constitute a part of this invention.

Although the invention has been particular disclosed for a device constructed out of heavy steel, it is to be understood that the invention is applicable for other materials such as reenforced plastics and other metals. It is also obvious to one of ordinary skill in the art that the foregoing is presented by way of example only and the invention is not to be unduly restricted thereby since modifications may be made in the structure of the various parts without functionally departing from the spirit of this invention.

What I claim is:

1. A vehicle barricade comprising:

A pivotally mounted barrier plate which can be raised or lowered about a pivot, at least one sector mounted near the end of said barrier plate, said sector having one edge thereof fixed to said barrier plate and extending rearwardly therefrom in an arc of approximately 135° so that said barrier plate is elevated at approximately 45° when raised, said sector having a counterweight fixed thereto so that said barrier plate remains raised or lowered unaided, and said counterweight located on said sector on the end of the arc opposite said barrier plate so that said sector and said barrier plate are balanced when said barrier plate is raised to approximately 22.5°.

2. A barricade as claimed in claim 1 having a sector mounted at each side of said barrier plate, said sectors being individually counterweighted.

3. A barricade as claimed in claim 1 further comprising a stop located behind said sector when in the raised position.

4. A barricade as claimed in claim 1 further comprising a pillar adjacent to said sector, a face on said pillar contacting said barrier plate when said barrier plate is raised.

5. A barricade as claimed in claim 4 further comprising a steel shaft mounted on said barrier plate, a keyway in said pillar face into which said shaft will fit when said barrier plate is raised.

6. A barricade as claimed in claim 1 further comprising a pivot shaft about which said barrier plate rotates, a seat in the surface on which said barrier plate is mounted for said pivot shaft, and a steel plate located adjacent to said shaft seat and secured both to said shaft seat and said surface.

7. A vehicle barricade comprising:

A pivotally mounted barrier plate which may be raised or lowered about its pivot, sectors mounted near the ends of said barrier plate, said sectors being counterweighted so that said barrier plate remains raised or lowered unaided, means for rotating said barrier plate about its pivot so as to raise or lower said barrier plate, pillars adjacent to said sectors, said pillars each having a face which said barrier plate abuts when raised, a steel shaft mounted on said barrier plate, a keyway in said pillar face into which said steel shaft fits when said barrier plate rotates to the raised position, a pivot shaft extending the length of said barrier plate about which said barrier plate rotates, a seat for said pivot shaft in a surface on which said barrier plate is mounted, and a steel plate located adjacent to said pivot shaft seat and secured both to said pivot shaft seat and said surface.

* * * * *